US005511528A

United States Patent [19]

Iwanaga et al.

[11] Patent Number: 5,511,528

[45] Date of Patent: Apr. 30, 1996

[54] ACCUMULATOR TYPE OF FUEL INJECTION DEVICE

[75] Inventors: Takashi Iwanaga, Toyohashi; Yasuhiro Kariya, Hino, both of Japan; Kenji Magario, Amsterdam, Netherlands; Takayoshi Kawaguchi, Oobu, Japan; Nobuhiko Shima, Nagoya, Japan; Mitsuru Ban, Okazaki, Japan

[73] Assignee: Nippondenso Co., Ltd., Kariya, Japan

[21] Appl. No.: 226,039

[22] Filed: Apr. 11, 1994

Related U.S. Application Data

[63] Continuation of Ser. No. 934,477, Nov. 16, 1992.

[30] Foreign Application Priority Data

| | | | |
|---|---|---|---|
| Jan. 14, 1991 | [JP] | Japan | 3-2757 |
| Jan. 24, 1991 | [JP] | Japan | 3-6908 |
| Mar. 15, 1991 | [JP] | Japan | 3-51450 |
| Jun. 26, 1991 | [JP] | Japan | 3-154901 |

[51] Int. Cl.[6] ..... F02M 37/04

[52] U.S. Cl. ..... 123/467; 123/198 DB

[58] Field of Search ..... 123/198 DB, 198 D, 123/467, 456, 506; 137/517, 498

[56] References Cited

U.S. PATENT DOCUMENTS

| | | | |
|---|---|---|---|
| 2,225,175 | 12/1940 | Koerner | 123/198 DB |
| 3,742,926 | 7/1973 | Kemp | 123/467 |
| 4,274,380 | 6/1981 | de Vulpillieres | 123/456 |
| 4,467,757 | 8/1984 | Dazzi | 123/198 DB |
| 4,539,959 | 9/1985 | Williams | 123/198 DB |
| 4,545,352 | 10/1985 | Jourde et al. . | |
| 4,589,393 | 5/1986 | Jourde | 123/198 DB |
| 4,633,836 | 1/1987 | Faupel | 123/467 |
| 4,649,884 | 3/1987 | Tuckey . | |
| 4,704,997 | 11/1987 | Endo et al. . | |
| 4,777,921 | 10/1988 | Miyaki . | |
| 5,058,553 | 10/1991 | Kondo . | |
| 5,168,855 | 12/1992 | Stone | 123/456 |
| 5,186,138 | 2/1993 | Hashimoto . | |
| 5,197,438 | 3/1993 | Yamamoto . | |
| 5,201,294 | 4/1993 | Osuka | 123/456 |
| 5,295,469 | 3/1994 | Kariya | 123/456 |

FOREIGN PATENT DOCUMENTS

| | | |
|---|---|---|
| 60-204957 | 10/1985 | Japan . |
| 62-38870 | 2/1987 | Japan . |

*Primary Examiner*—Carl S. Miller

*Attorney, Agent, or Firm*—Cushman, Darby & Cushman

[57] ABSTRACT

In a system in which a common rail accumulates fuel pressurized by a high pressure supply pump, when a pipe connected to the common rail is damaged or a pulsation of fuel injection is caused in the system, reliability of the system is greatly affected because of high pressure. According to the present invention, a mechanism to prevent leakage of fuel from the common rail even when the pipe is damaged, or a mechanism to damp a pulsation of fuel pressure, is provided in a pipe close to the common rail. Therefore, reliability of the system is improved.

2 Claims, 10 Drawing Sheets

ACCUMULATOR TYPE OF FUEL INJECTION DEVICE

This is a continuation of application Ser. No. 07/934,477, filed Nov. 16, 1992.

FIELD OF ART

The present invention relates to an accumulator type of fuel injection device used for diesel engines.

BACKGROUND ART

An accumulator type fuel injection device, used for diesel engines, is disclosed in Japanese Patent Application Laid Open No. 165858- 1984. In this fuel injection device, fuel high pressure sent from a high pressure fuel pump is stored in a surge tank referred to as a common rail, and the stored fuel is injected into an engine when an injection valve is opened. An appropriate fuel injection device is disclosed in Japanese Patent Application Laid Open No. 159366-1985 in which a safety device is provided in the fuel passage to an injection valve, and when at least a predetermined amount of fuel is supplied to the injection valve, the fuel supply passage is closed.

However, very high pressure (for example, 150 Mpa) is stored in the common rail, so that a portion of the ultra-high pressure fuel passage provided from the high pressure fuel pump to the injection valve, through the common rail, may become damaged and high pressure fuel may leak out. Also reflection pressure waves, generated by an injection valve of one cylinder, may be transmitted to other cylinders through the common rail, so that the opening and closing timing of the cylinder is affected changing the injection amount and timing.

It is a primary object of the present invention to improve the reliability of a fuel injection system by providing a mechanism which maintains high pressure fuel in a common rail even when a high pressure fuel passage connected to the common rail, for example, an injection pipe between the common rail and the injection valve, or a supply pipe between the high pressure supply pump and the common rail, is damaged, or by providing a mechanism which prevents the occurrence of pulsations of high pressure fuel.

SUMMARY OF THE INVENTION

In order to attain the object of the invention, the fuel injection device of the first embodiment comprises a mechanism that stops a flow of fuel when the amount of fuel which flows from a common rail to an injector exceeds a predetermined value.

The fuel injection device of the second embodiment comprises a mechanism which prevents a back flow of fuel from the common rail to a high pressure pump.

The fuel injection device of the third embodiment comprises a mechanism which prevents a back flow of fuel from the injector to the common rail.

The fourth embodiment provides a fuel injection device in which the mechanism of the first embodiment and that of the third embodiment are combined.

PREFERRED EMBODIMENTS TO CARRY OUT THE INVENTION

With reference to the attached drawings, an example of the present invention will be explained.

Figure 1:
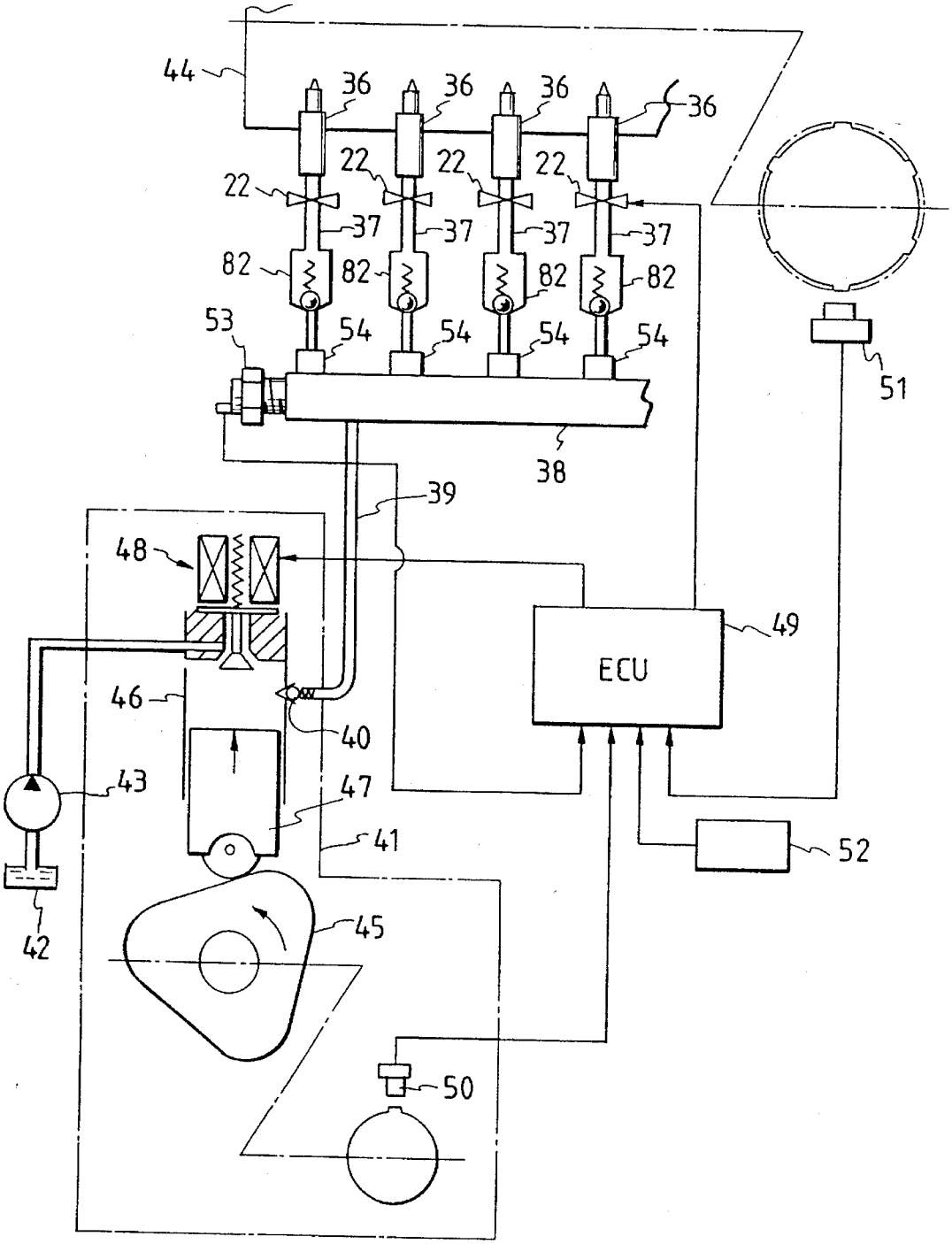
FIG. 1 is a schematic illustration showing the entire structure of the first example.
Figure 2:
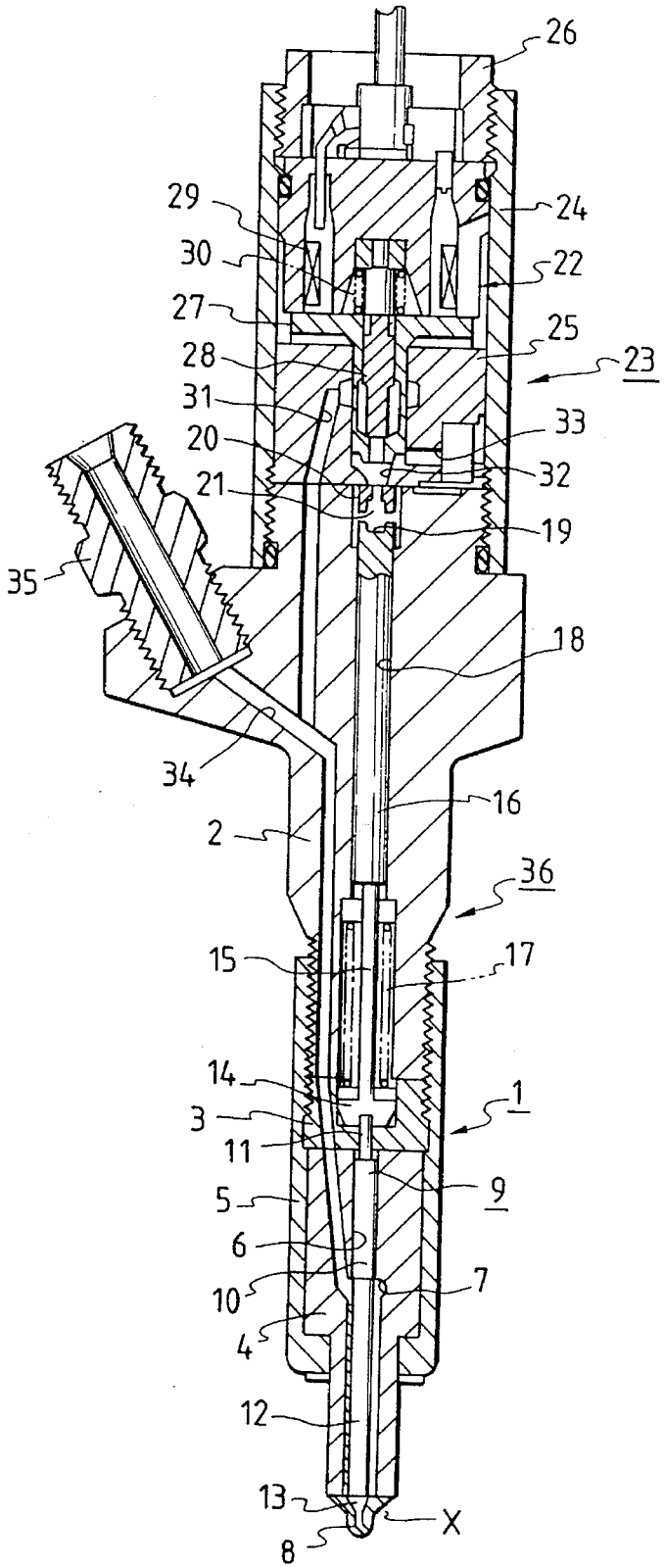
FIG. 2 is a sectional view of an injector.

FIG. 1 shows the entire structure of a fuel injection device for use in a diesel engine. FIG. 2 shows an injector 36 provided in each of the combustion chambers of a diesel engine.

In FIG. 2, a lower casing member 1 comprises a lower body 2, a connecting portion 3 and a nozzle body 4, and the members 2, 3 and 4 are integrated into one unit by a retaining nut 5. In the nozzle body 4, a valve body sliding hole 6 and a fuel reserving chamber 7 are formed, and a nozzle hole 8 communicating with the fuel reserving chamber 7 is formed at the top of the nozzle body 4. A large diameter portion 10 of a nozzle needle 9 is slidably engaged in the valve body sliding hole 6. A connecting portion 11 is provided to the large diameter portion 10 of the nozzle needle 9, and a small diameter portion 12 and a valve body portion 13 are provided to the lower end portion of the nozzle needle 9. When seat portion X is opened or closed by the valve body portion 13, fuel injection from the nozzle hole 8 is turned on and off.

A flange 14 and a piston pin 15 are integrally connected with the tip of the connecting portion 11 of the needle 9, and a piston 16 is disposed at the end of the piston pin 15. The nozzle needle 9 is pushed by a spring 17 in a closing direction. The piston 16 is slidably engaged in a cylinder 18 formed in the lower body 2, and in the cylinder 18, a compression control chamber 19 is formed into which the tip of the piston 16 is extended.

A plate valve 20 having an orifice is provided in the upper portion of the pressure control chamber 19, and a spring 21 to push the plate valve 20 is also provided in the pressure control chamber 19.

An upper casing member 23, having a three-way control valve (an electromagnetic valve) 22, is closely attached onto the lower body 2. That is, a cylindrical upper body 24 is screwed to the lower body 2. A three-way valve body 25 is located in an inside hole of the upper body 24, and a retaining nut 26 is screwed into the inside hole of the body upper 24.

An outer valve 27 is slidably engaged in the three-way valve body 25, and an inner valve 28 is disposed in the inside hole of the outer valve 27. When a coil 29 is not energized, the outer valve 27 is located in a lower position due to the force of a spring 30, so that a high pressure side passage 31 and the pressure control chamber 19 communicated with each other through an oil passage 32. When the coil 29 is energized, the outer valve 27 is moved upward, so that the pressure control chamber 19 and a drain passage (a low pressure side passage) 33 communicate with each other through the oil passage 32.

A fuel supply passage 34 is formed in the lower casing member 1, and one end of the fuel supply passage 34 is exposed onto the surface of the casing member the body lower 2) 1, and the other end is communicated with the fuel reserving chamber 7 and the high pressure side passage 31 of the upper casing member 23. Further, an inlet 35 is screwed onto the surface of the lower casing member (the body lower 2) 1 so that the inlet 35 communicates with the fuel supply passage 34.

High pressure fuel in an accumulator pipe (a common rail) 38 described later, is supplied to the fuel reserving chamber 7 through the inlet 35 and the fuel supply passage 34, and at the same time fuel is supplied to the three-way control valve 22. Fuel in the drain passage 33 can be removed to a drain tank. Consequently, when high pressure fuel is supplied to the pressure control chamber 19, a valve closing force generated by the aforementioned high pressure fuel in the direction from the piston 16 to the needle 9, is higher than a valve opening force generated by the fuel in the fuel reserving chamber 7, so that the needle 9 closes the nozzle hole 8. Under the aforementioned condition, the three-way valve 22 is controlled, so that the pressure control chamber 19 communicates with the drain passage 33 on the low pressure side, and the fuel in the pressure control chamber 19 flows out to the low pressure side. Accordingly, the nozzle needle 9 is moved in an opening direction so that it can be opened and fuel can be injected. At this time, the hydraulic pressure is gradually decreased by the action of an orifice of the brake valve 20.

As shown in FIG. 1, each injector 36 is connected with the high pressure accumulator pipe 38 which is common among the cylinders, though the injection pipe 37. The accumulator pipe 38 is connected with a high pressure supply pump 41 through a supply pipe 39 and a check valve 40. This high pressure supply pump 41 boosts the pressure of the fuel which has been sucked from a fuel tank 42, by a low pressure fuel pump 43, to a predetermined high pressure so that the pressure can be controlled. That is, the high pressure supply pump 41 is operated in the following manner: a cam 45 is rotated synchronously with the rotation of engine 44; a piston in a cylinder 46 is reciprocated; and the fuel sent from the low pressure supply pump 43 is boosted and supplied to the accumulator pipe 38. In order to control the pressure of fuel in the accumulator pipe 38, that is, in order to control an injected amount of fuel supplied to the accumulator pipe 38, the high pressure supply pump 41 is provided with an electromagnetic valve 48 for controlling the delivery amount, wherein the electromagnetic valve 48 is closed at a predetermined timing while the fuel is being sent out by the high pressure pump 41.

Information about the rotation and load of the engine is inputted into an electronic control unit (ECU), 49 by a cylinder discriminating sensor 50, a crank angle sensor 51 and a load sensor 52. Then, ECU 49 outputs a control signal to the three-way control valve 22 so that the most appropriate injection timing and injection amount (injection time) can be provided in accordance with the state of the engine judged by the aforementioned information.

A pressure sensor 53 for detecting the pressure in the accumulator pipe 38 is disposed in the accumulator pipe 38, and the ECU 49 controls the delivery amount so that the signal obtained by the pressure sensor 53 will be the most optimum value which has been previously set in accordance with the load and engine speed. That is, negative feedback control of pressure is carried out so that a more accurate pressure setting is conducted. The delivery amount is increased when delivery timing TF of the high pressure supply pump 41 is advanced.

Figure 3:
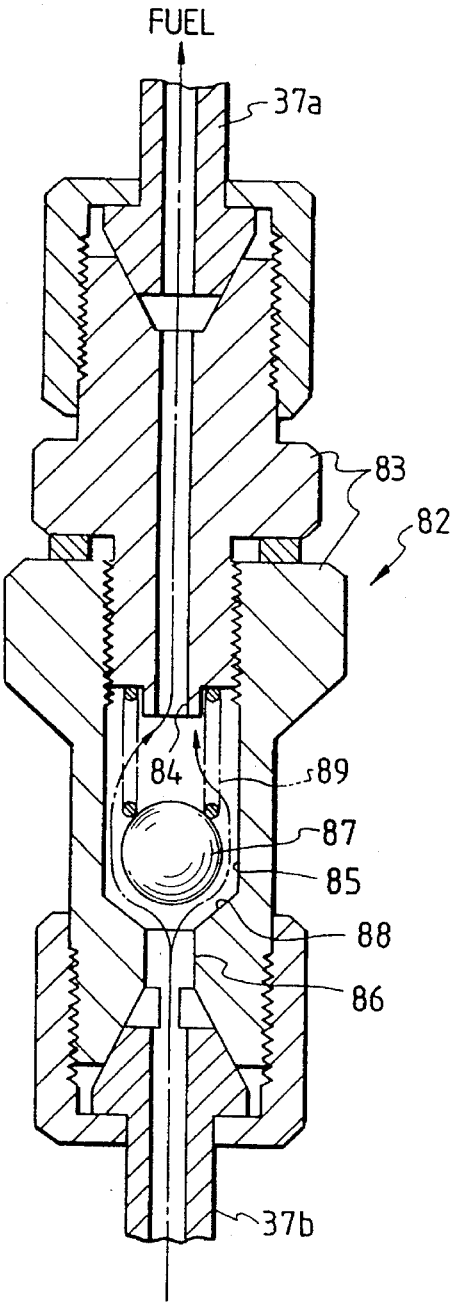
FIG. 3 is a sectional view of a check valve.
Figure 4:
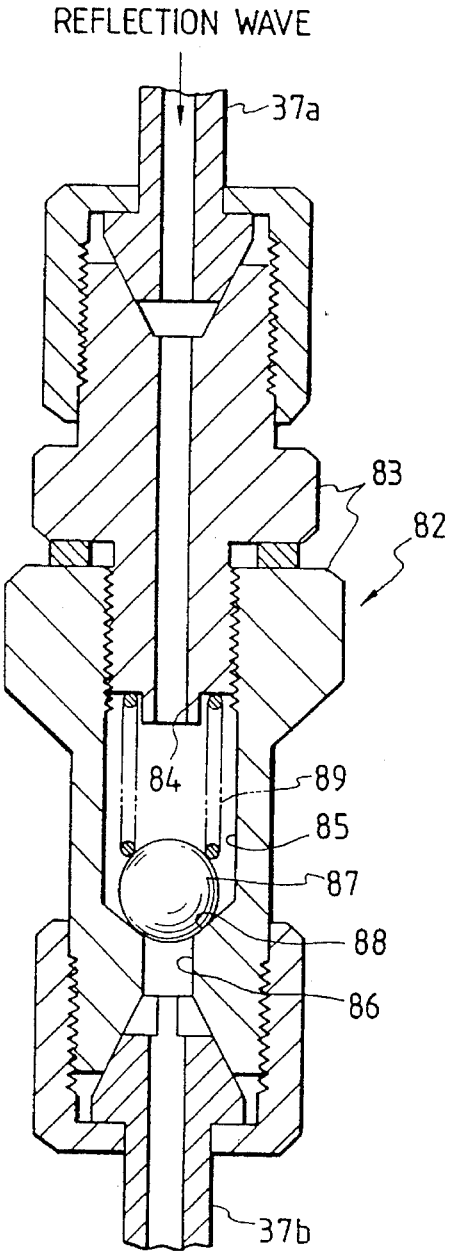
FIG. 4 is a sectional view showing the operation of the check valve.

A check valve 82 is provided in the middle of the injection pipe 37. As shown in FIG. 3, a fuel passage 84, a valve body accommodation chamber 85 and a fuel passage 86 are provided in a housing 83 of the check valve 82. A ball valve 87 is disposed in the valve body accommodation chamber 85, and a spring 89 for pushing the ball valve 87 against a valve seat 88 is also disposed in the chamber 85. A fuel passage 84 is connected with an injection pipe 37*a*, which is communicated with the injection valve 36. A fuel passage 86 is connected with an injection pipe 37*b*, which is communicated with the accumulator pipe 38.

The setting load of the spring 89 of the check valve 82 is determined in such a manner that the setting load is lower than the product ($=P_{min}\cdot A1$) of the minimum pressure $P_{min}$ in the common rail and the pressure receiving area A1 of the ball valve. The ball valve 87 is lifted by the inner pressure of the accumulator pipe 38 so that fuel passes through the check valve. The maximum load of the spring 89 is set at a value higher than the product ($=P_{max}\cdot A1$) of the maximum pressure $P_{max}$ in the accumulator pipe and the pressure receiving area A1 of the ball valve. Accordingly, even when the pressure is increased to $P_{max}$, the ball valve 87 does not block the upper fuel passage 84.

When a reflection pressure wave is generated in the injection pipe 37 after the completion of fuel injection conducted by the injector 36, the reflection wave is directed from the injector 36 to the accumulator pipe 38, wherein the ball valve 87 is closed so that transmission of the reflection pressure wave into the accumulator pipe 38 can be prevented. Due to the foregoing, interference (pressure change in the accumulator pipe) between the cylinders, which causes the fluctuation of injection timing and injection amount, can be prevented.

Figure 5:
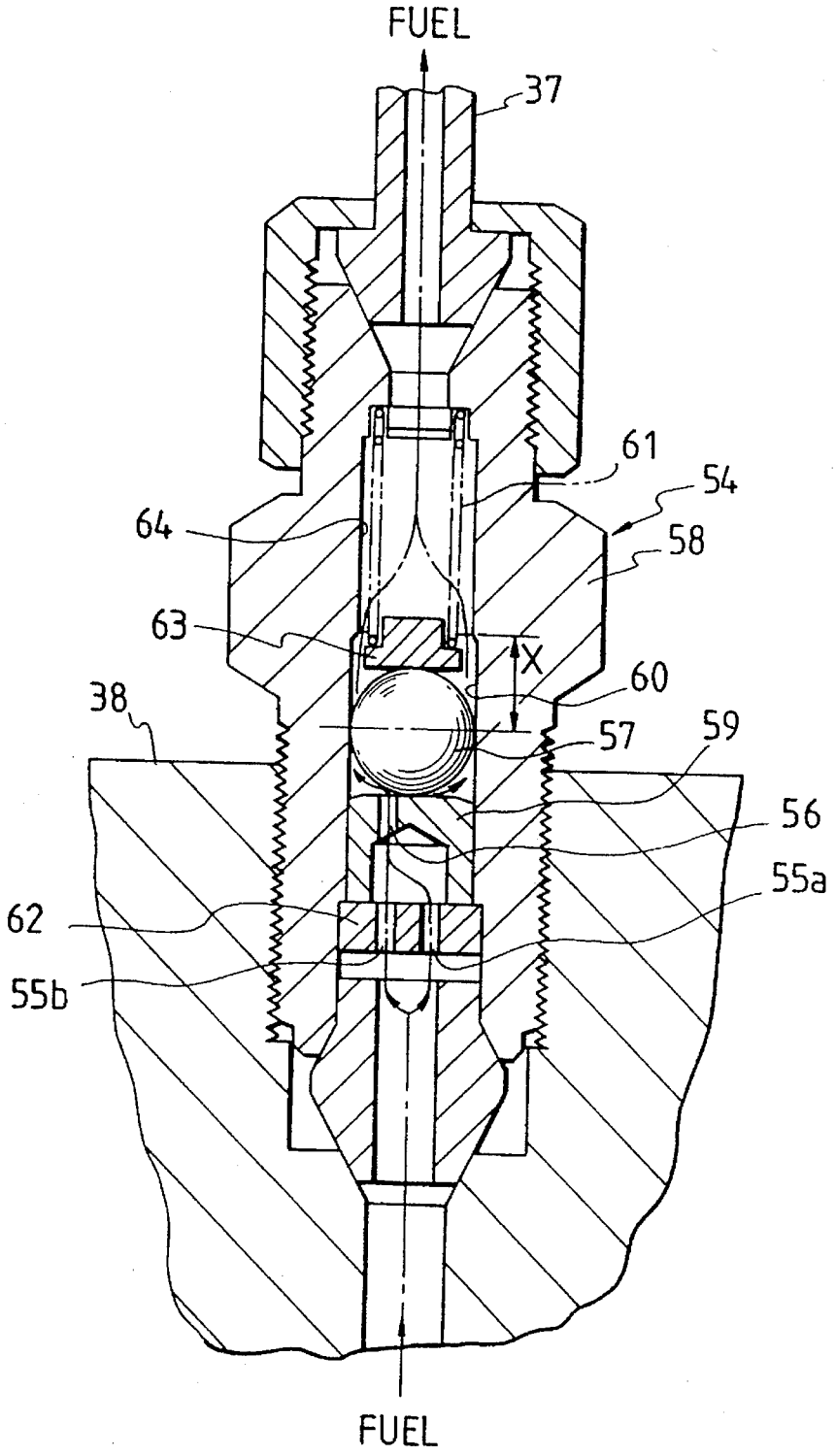
FIG. 5 is a sectional view of a safety device.

As shown in FIG. 5, a safety device (a flow limiter) 54 is provided between the accumulator pipe 38 and the injection pipe 37.

This safety device 54 includes a housing 58 having a hollow cylindrical hole 60, a piston 59 which is disposed in the hollow cylindrical hole 60 and moved in accordance with the amount of fuel supplied from the accumulator pipe 38, a press-fitted restricting member 62 which restricts the position of the piston 59 on the side of the accumulator pipe 38, a ball valve 57 which is moved integrally with the piston 59, a spring 61 which pushes the ball valve 57 to the side of the accumulator pipe 38, and a retainer 63 which connects and holds the ball valve 57 and the spring 61 being disposed between the ball valve 57 and the spring 61. A press-fitting hole 64 is formed on the injection pipe 37 side of the hollow cylindrical hole 60, and the diameter of the press-fitting hole 64 is smaller than the outside diameter. The restricting member 62 is provided with orifices 55*a*, 55*b*, and the piston 59 is provided with an orifice 56.

Next, the operation of the safety device 54 will be explained as follows.

Figure 7:
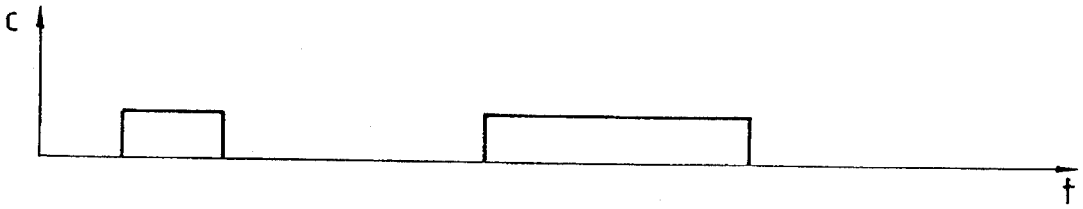
FIG. 7 is a characteristic diagram showing a relation between time t and injection period c.
Figure 8:
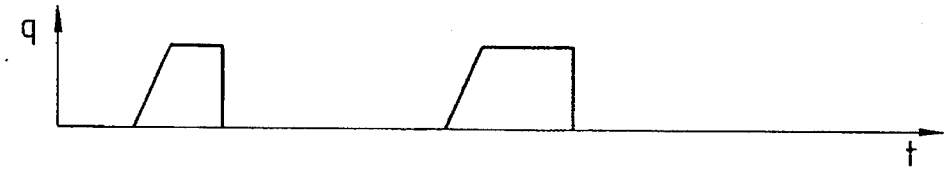
FIG. 8 is a characteristic diagram showing a relation between time t and injection amount q.
Figure 9:
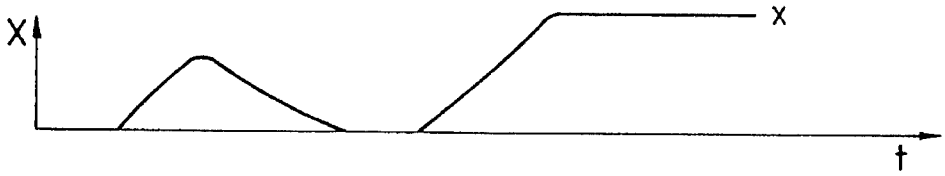
FIG. 9 is a characteristic diagram showing a relation between time t and and movement amount x of a ball 57.

FIG. 7 through FIG. 9 are time charts respectively showing a relation between injection period c and time, a relation between fuel injection amount q and time, and a relation between movement amount x of the ball 57 and time.

In a usual (normal) operation of the safety device 54, as the injector 22 is operated, an amount of fuel coincident with the injection amount flows into the safety device 54 from the accumulator pipe 38. This fuel flows into the housing 58 through the orifices 55*a*, 55*b* of the restricting member 62, and moves the piston 59 in accordance with the flow amount. As the piston 59 is moved, the ball 57 is also moved. The movement amount of the ball 57 is set at a predetermined value so that the amount of movement x caused by the flow of fuel does not exceed an allowed value x corresponding to the distance from the center of the ball 57 to the press-fitting hole. Therefore, the fuel which has flown into the housing 58 through the orifice 56 of the piston 59, passes around the ball 57, and then passes through the press-fitting hole 64 and the injection pipe 37. After that, the fuel is supplied to the injector 22 from the injection pipe 37.

Figure 6:
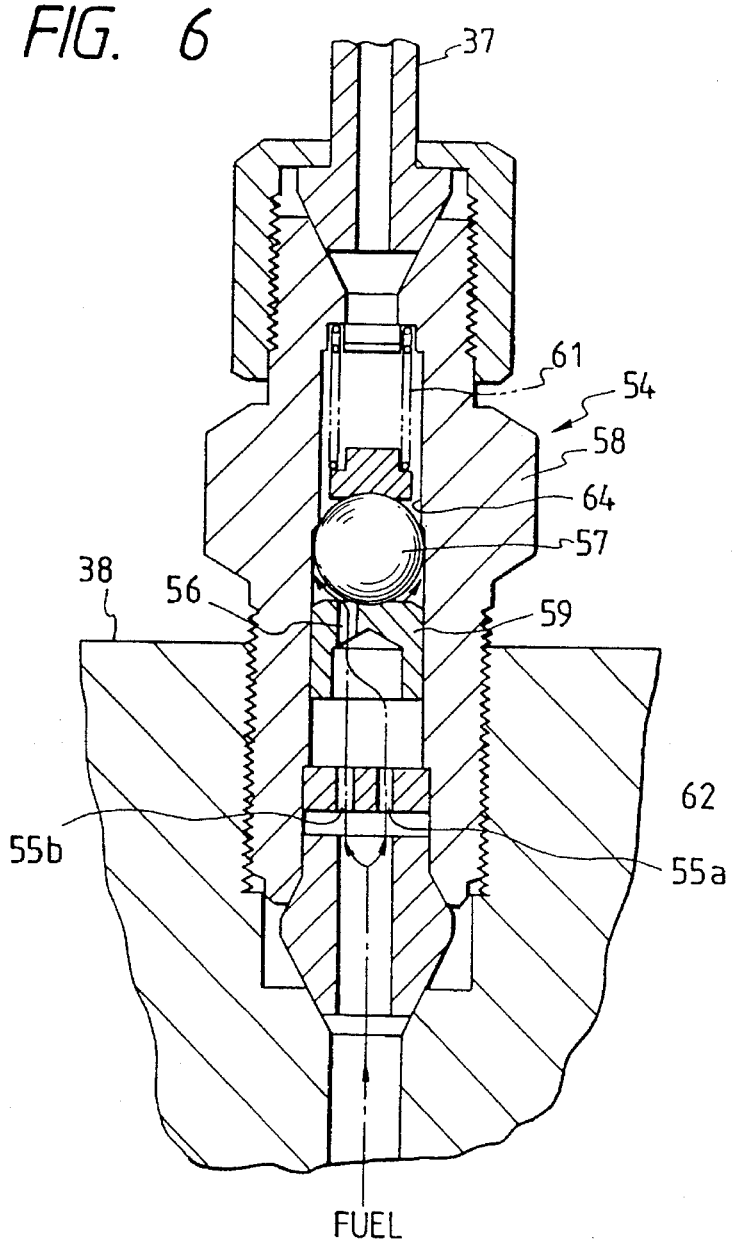
FIG. 6 is a sectional view showing the operation of the safety valve.

On the other hand, when a bug is caused in a microcomputer in ECU49, or when a problem is caused in the three-way control valve 22, the injection period of the injector 36 is extended and movement amount x of the ball 57 exceeds allowed value x. In this case, the ball 57 is press-fitted into the press-fitting hole 64 as shown in FIG. 6, so that the ball 57 is permanently engaged in the hole. Therefore, the safety device 54 completely stops the supply of fuel to the injector 36.

Since the safety device 54 is disposed between the accumulator pipe 38 and the injector pipe 37, even when the injection pipe 37 is damaged, fuel supply to the injection pipe 37 is completely stopped by the safety device 54 in the same manner as a case in which the injector 36 is damaged.

Accordingly, not only in the case of damage to the injector 36 but also in the case of damage to the injection pipe 37, fuel supply from the accumulator pipe 38 to the injector 36 is stopped by the safety device 54, so that safety is greatly improved.

Figure 10:
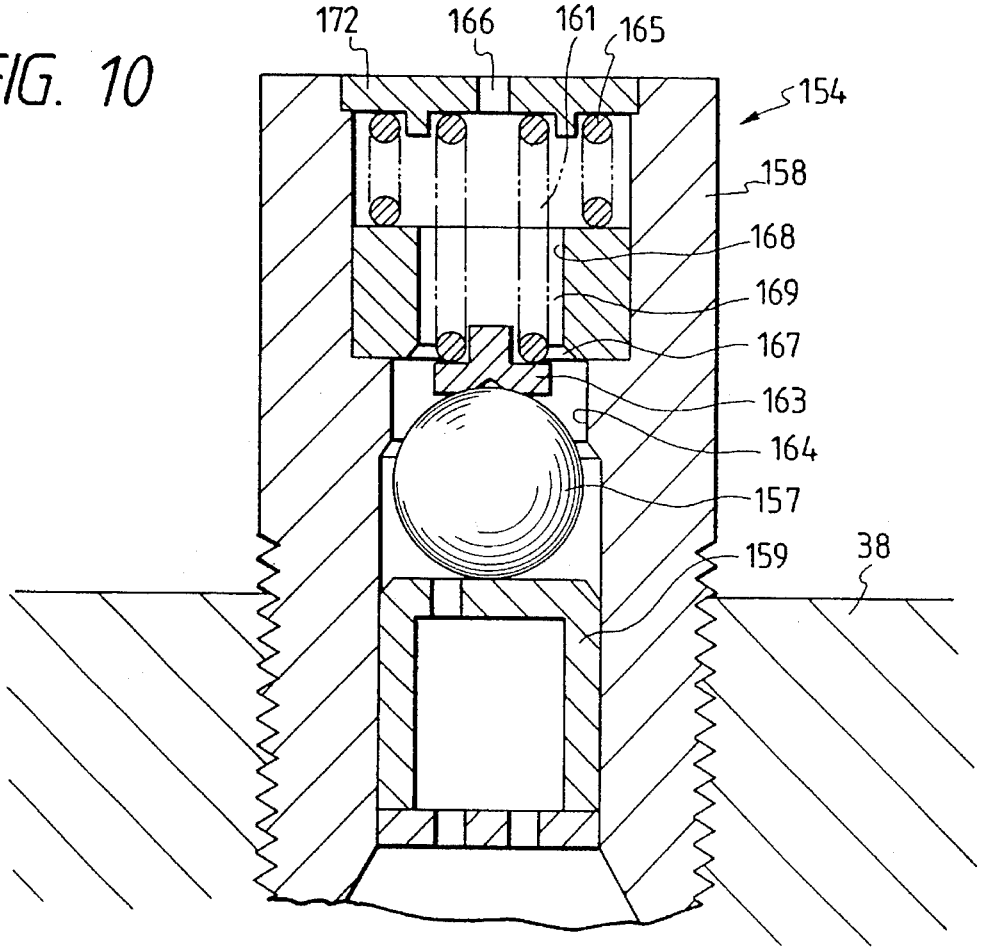
FIG. 10 is a sectional view showing another example of a safety device.

With reference to FIG. 10, another example of the safety device 54 is explained as follows.

In the example shown in FIG. 5, when the ball 57 is press-fitted into the press-fitting hole 64, fuel supply to the injector 36 is permanently stopped. In the example shown in FIG. 10, when an amount of fuel which flows in the safety device 54 temporarily exceeds an allowed value, fuel supply to the injector 36 is temporarily stopped, and when the amount of fuel continuously exceeds the allowed value, the fuel supply to the injector 36 is permanently stopped.

That is, as shown in FIG. 10, a seat member 168 having a seat portion 167 on which a ball 157 is seated and also having a passage 169, is movably disposed in a housing 158, and the seat member 168 is pushed by a return spring 165. The diameter of a press-fitting hole 164 is larger than the outer diameter of the ball 157, and smaller than the outer diameter of a piston 159. Springs 161 and 165 are held by a spacer 172 provided with a fuel passage 166. In this example, when an amount of fuel which flows in safety device 154 temporarily exceeds an allowed value, the piston 159 and the ball 157 are moved, and the ball is seated on the seat portion 167 of the seat member 168 so that the fuel supply to the injector 36 is temporarily stopped. When the amount of fuel which flows in the safety device 154 returns to an allowable range, the piston 159 and the ball 157 are returned by the spring 161, so that the fuel sent from the accumulator pipe 38 is supplied to the injector 36 again through the safety device 154.

In the case where an abnormality has occurred in the injector 36 or the injection pipe 37 has been damaged so that an amount of fuel which flows in the safety device 154 exceeds the allowable range continuously, the piston 159 and the ball 157 are moved, and the piston 159 is press-fitted into the press-fitting hole 164. Therefore, the movement of the ball 57 is perfectly restricted, and the fuel supply to the injector 22 is permanently stopped.

Next, an example in which the check valve 82 and the safety valve 54 are integrally provided, will be explained as follows.

Figure 11:
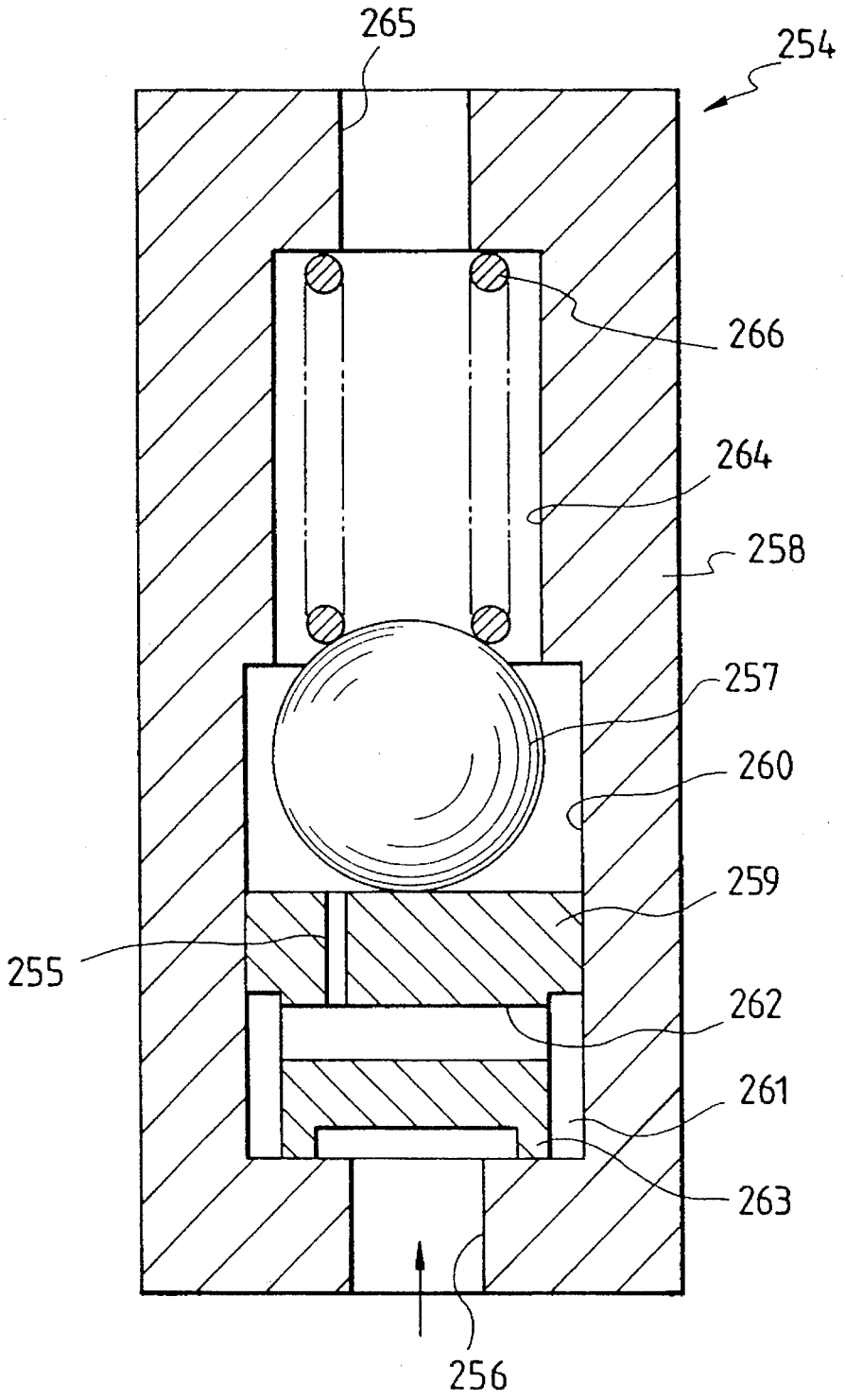
FIG. 11 is a sectional view of an example in which a safety valve and a check valve are combined.

A safety device shown in FIG. 11 is provided between the common rail 38 and the injection pipe 37. The safety device 254 includes: a housing 258 in which an inlet 256, a hollow cylindrical hole 260, a press-fitting hole 264 and an outlet 265 are formed; a piston 259 which is slidably provided in the hollow cylindrical hole 260; a ball valve 257; and a spring 266 which pushes the ball valve 257 toward the inlet 256. In the piston 259, an orifice 255 formed in the axial direction and a passage 262 formed in the radial direction are provided, and further a circular seat portion which blocks the inlet 256 is provided in the piston 259.

Next, the operation of this safety device 254 will be explained.

When this safety device 254 is operated normally (usually), an amount of fuel coincident with the injection amount of the injector 36 flows into the safety device 254 from the common rail 38.

The fuel flows into the housing 258 from the inlet 256, and moves the piston 259 in accordance with the amount of fuel, resisting the force of the spring 266. The ball 257 is integrally moved in accordance with the movement of the piston 259. In a normal operating condition, an amount of movement of the ball 257 is set at a value which does not exceed an allowed value corresponding to the distance from the center of the ball 257 to the press-fitting hole 264. Therefore, fuel passes from the inlet 256 to the outlet 265 through a circular chamber 261 formed around the circular seat portion 263, a passage 262 formed in a radial direction and an orifice 255, and further passes through around the ball 257. Fuel is supplied from the outlet 265 to the injector 36 through the injection pipe 37.

When an amount of fuel is decreased which flows into the injector 36 from the common rail 38, is decreased the ball 257 and the piston 259 are pushed back by the force of the spring 266, so that the inlet 256 of the circular seat portion 263 is blocked. Therefore, fuel injection conducted by the injector 36 is finished. In the case where a reflection pressure wave is generated and is transmitted from the injector 36 to the accumulator pipe 38, the circular seat portion 263 of the piston 259 blocks the inlet 256, so that the transmission of the reflection pressure wave to the common rail 38 can be prevented. Due to the foregoing, interference (the pressure change in the common rail 38) between the cylinders which causes the fluctuations of injection timing and injection amount, can be prevented.

In the case where the injection timing of the injector 36 is extended when an error occurs in a microcomputer in ECU49, or when an abnormality is caused in the three-way control valve 22, an amount of fuel which flows into the safety device 254 from the common rail 38 is increased. Then, the movement amount of the ball 257 and the piston 259 exceed an allowable range, so that the ball 257 is press-fitted into the press-fitting hole 264 and fixed permanently. Therefore, the safety device 254 completely stops the fuel supply to the injector 36.

As explained above, according to the present example, when an abnormality is caused, the fuel supply from the common rail 38 to the injector 36 can be stopped by the safety device 254. Further, since the circular seat portion 263 of the piston 259 blocks the inlet 256 when the fuel injection conducted by the injector 36 has been finished, the reflection pressure wave is prevented from being transmitted into the common rail 38. Furthermore, the aforementioned different mechanisms are integrally provided in the safety device 254, so that the assembling efficiency can be greatly improved.

Figure 12:
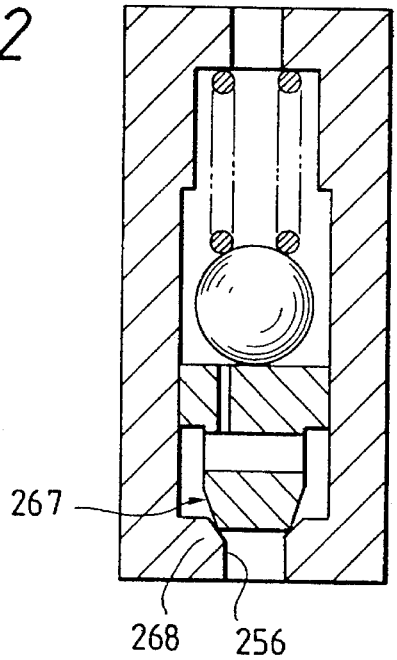
FIGS. 12 and 13 show a variation of the example shown in FIG. 11.

Although the safety device 254 is disposed between the common rail 38 and the injection pipe 37 in this example, the safety device 254 may be disposed in any position of the fuel pipe between the common rail 38 and the injector 36. The edge portion of the piston 259 may be formed into a tapered shape 267 as shown in FIG. 12 so that a seat surface 268 of an inlet 256 may be opened and closed.

Next, with reference to FIG. 13, another example will be explained as follows.

Figure 13:
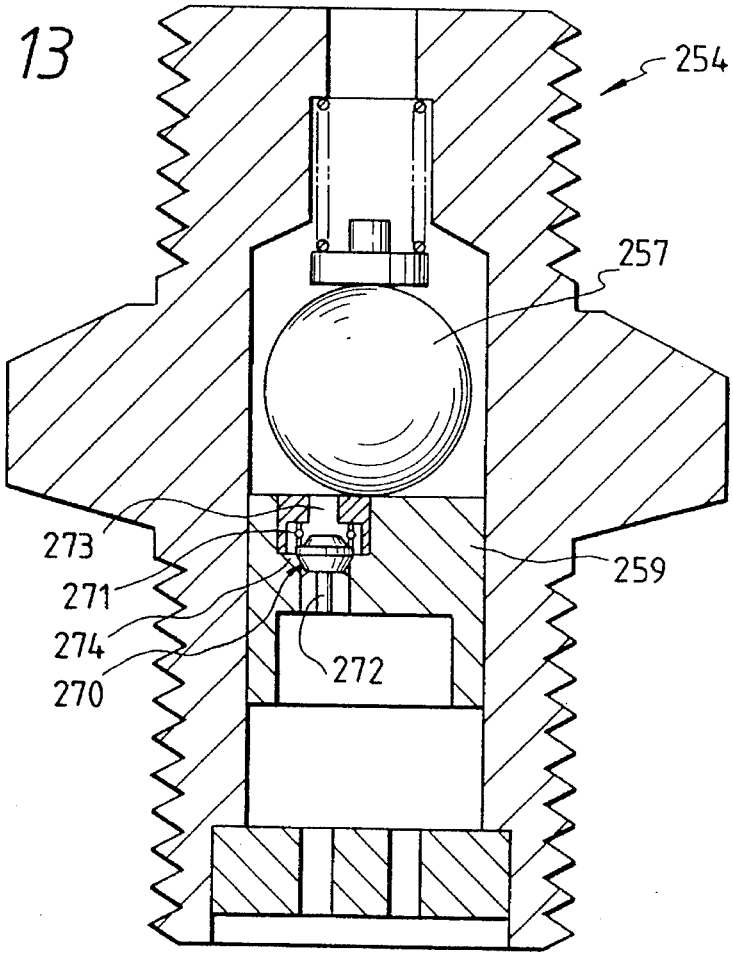

In the example shown in FIG. 13, an axial direction passage 273 is formed in the piston 259, and a seat portion 274 is formed in this passage, and a check valve 270 which opens and closes the seat portion 274 is also provided in the passage. This check valve 270 consists of a plunger valve 272 and a spring 271. When fuel flows from the common rail 38 to the injector 36, the check valve 270 is opened, and when pressure is transmitted from the injector 36 to the common rail 38, the check valve 270 is closed, so that the check valve 270 provides the same effect as the example shown in FIG. 11.

Next, an example shown in FIG. 14 will be explained. This example prevents interference between the injectors.

A check valve 362 is provided in a connecting portion of the injection pipe 37 and the common rail 38. As shown in FIG. 14, a valve body accommodation chamber 365 is provided in the common rail 38 so that the valve body accommodation chamber 365 is communicated with an inside passage 38*a* of the common rail 38. This valve body accommodation chamber 365 includes: a check valve 362 constituted of a plunger valve 366 and a spring 367, whereby the check valve 363 allows a fuel flow from the common rail 38 to the injection pipe 37, and cuts off a fuel flow from the injection pipe 37 to the common rail 38; and a seat member 368 having a seat 369 which is contacted with and separated from the plunger valve 366. When a fuel joint 370 connected with the injection pipe 37 is screwed into the common rail 38, the seat member 368 is fixed and the spring 367 is held.

When the aforementioned plunger valve 366 is seated on the valve seat, it sucks the fuel pressure in the injection pipe 37 into the common rail 38.

A setting load of the spring 367 of the check valve 362 is set at a value smaller than the product ($=P_{min}\cdot A1$) of the minimum pressure $P_{min}$ inside the common rail and the pressure receiving area A1 of the plunger valve 366. Accordingly, the plunger valve 366 is lifted by the inside pressure of the common rail so that fuel can pass through the plunger valve 366. The maximum load of the spring 367 is set at a value larger than the product ($=P_{max}\cdot A1$) of the maximum pressure $P_{max}$ inside the common rail and the pressure receiving area A1.

Figure 14:
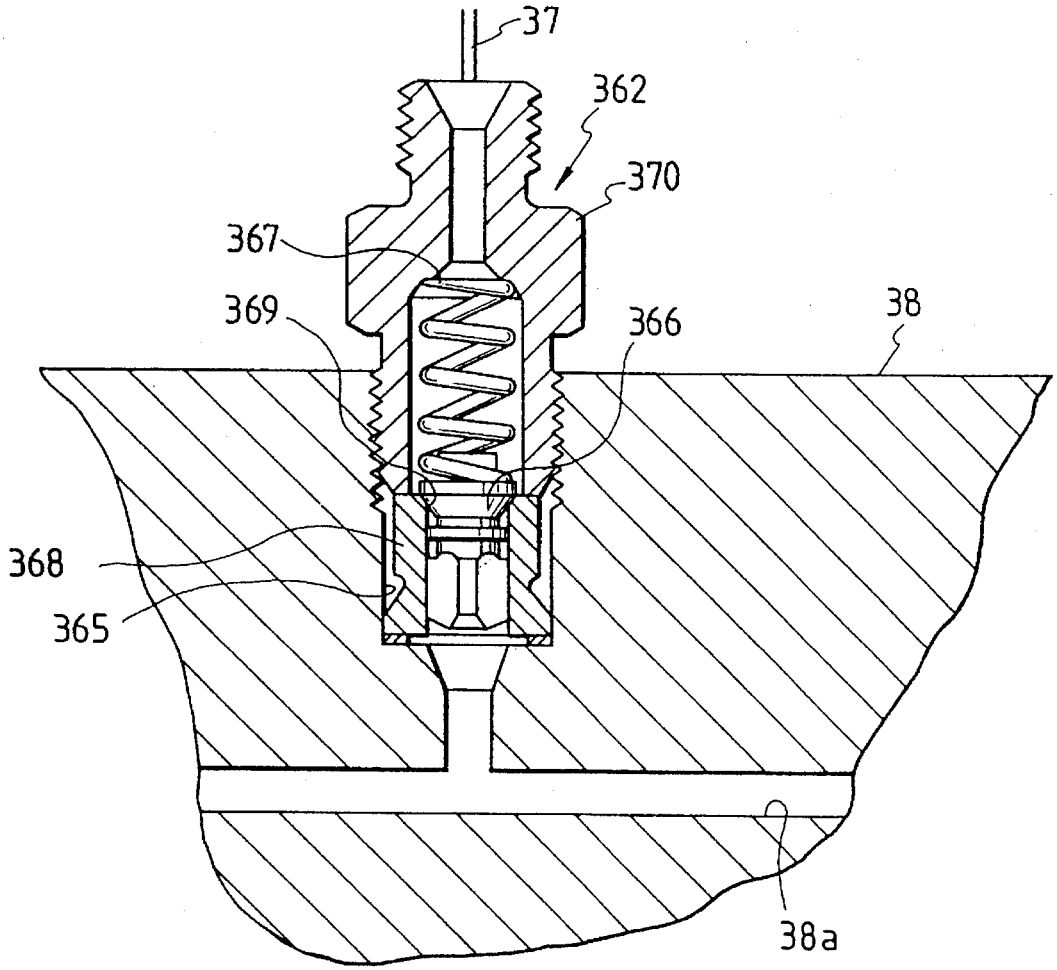
FIG. 14 is a sectional view of the third example.

When fuel injection conducted by the the injector 36 is completed and a reflection pressure wave is generated in the injection pipe 37 from the injector 36 side to the common rail side 38, the plunger valve 367 is closed as shown in FIG. 14, so that the transmission of the reflection pressure wave to the common rail can be prevented. Due to the foregoing, interference (change of pressure inside the common rail) between the cylinders which causes the fluctuations of the injection period and the injection amount can be prevented.

Since the check valve 363 can be previously assembled into the common rail 38, it is very easy to connect the common rail 38 with the injector 36 through the injection pipe 37 during the assembly of an engine. Accordingly, the workability can be greatly improved.

As explained above, in this example, the check valve 362 (the checking member) which allows the fuel supply from the common rail 38 to the injector 36 and restricts the pressure transmission from the injector 36 to the common rail 38, is provided in the connecting portion of the injection pipe 37 and the common rail 38, so that the check valve 362 restricts the transmission of a reflection pressure wave, which is caused when fuel is injected, from the injection valve 36 side to the common rail 38 side. As a result, interference between the cylinders caused by a reflection pressure wave, which causes fluctuations of the injection period and the injection amount, can be prevented over all the internal combustion engine revolution range. Further, since the check valve 362 can be previously assembled into the common rail 38, workability is greatly improved in the process of engine assembly.

In the examples shown in FIGS. 1 and 10, a safety device is disposed between the common rail 38 and the injection pipe 37. When the same safety device is disposed in the connecting portion between the supply pipe 39 and the common rail 38, leakage of high pressure fuel from the common rail 38 can be prevented even when a pipe between the high pressure supply pump 41 and the common rail 38 is damaged.

Figure 15:
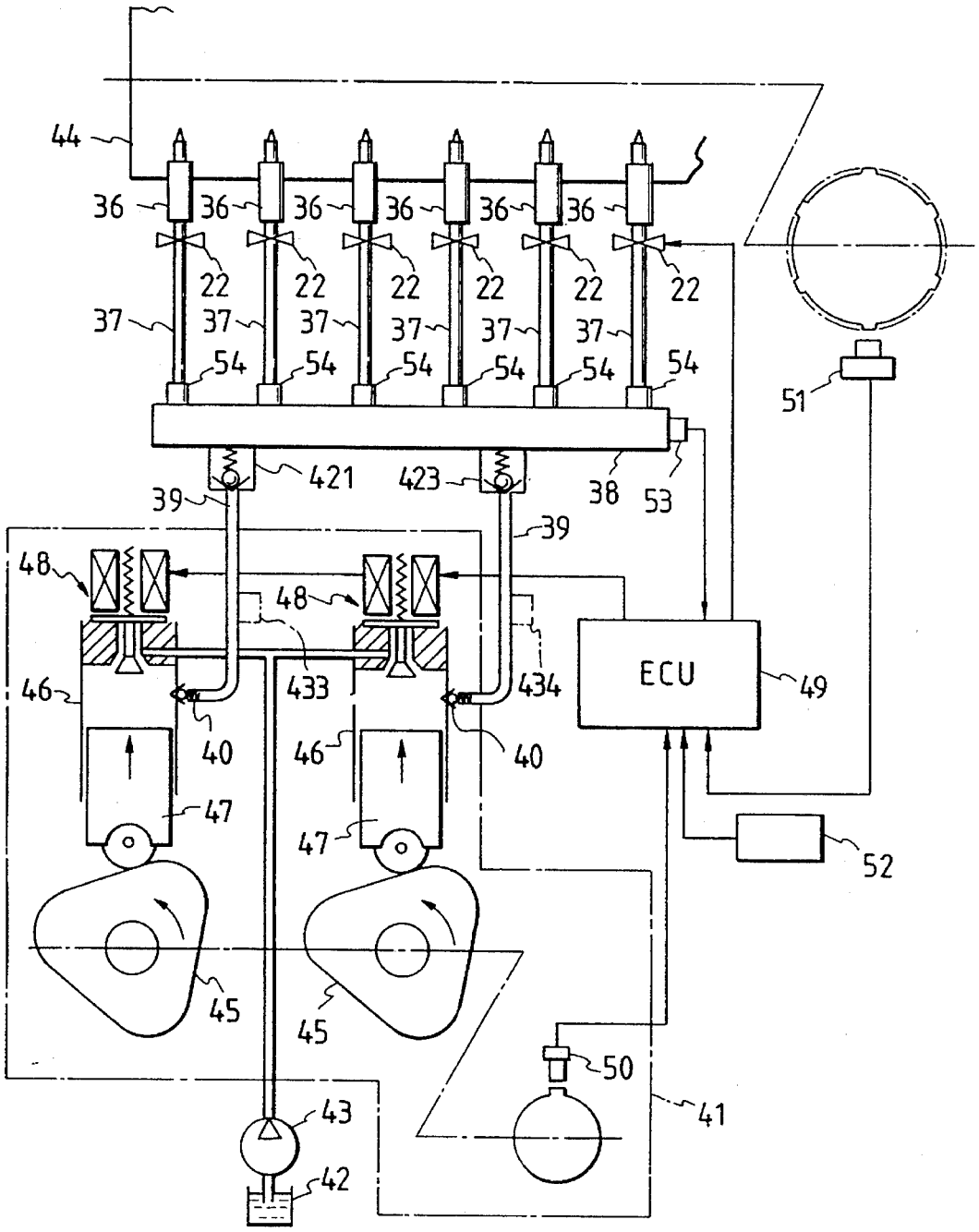
FIG. 15 is a schematic illustration showing the entire structure of the fourth example.

In this case, the check valves 421 and 423 shown in FIG. 15 may be used for the safety device. These check valves 421, 423 allow the fuel supply from the high pressure pump side to the common rail side, and restricts the fuel passage from the common rail side to the high pressure pump side.

On the other hand, when the fuel supply pipe 39 is damaged, the high pressure fuel in the common rail 38 is restricted by the check valves 421, 423 so that it can not pass to the fuel supply 39 side. Therefore, the high pressure fuel does not return to the high pressure pump side. Accordingly, when the fuel supply pipe 39 is damaged, leakage of fuel from the common rail side can be prevented.

In the case of damage of the fuel supply pipe 39, the amount of fuel to be supplied from the high pressure pump 48 to the common rail 38 is reduced. Accordingly, in order to control the common rail pressure to a predetermined value, fuel delivery timing TF (an amount of fuel delivery) is set to be early (small). Therefore, when TF becomes smaller than a predetermined value T0, the ECU49 assumes that the fuel supply pipe 39 has been damaged, and stops driving the high pressure pump 48 and injecting fuel.

As described above, in this example, the check valves 421, 423 are disposed in the end portion of the fuel supply pipe 39 on the common rail 38 side to allow fuel supply from the high pressure pump 48 to the common rail 38 and to restrict fuel passage from the common rail 38 to the high pressure pump 48. As a result, even when the fuel supply pipe 39 is damaged, fuel passage from the common rail 38 to the fuel supply pipe 39 is restricted by the check valves 421, 423, so that leakage of high pressure fuel can be prevented.

Next, a system will be explained which works in such a manner that fuel is supplied only by one fuel supply system when the other fuel supply system has been damaged, wherein in a normal condition, fuel is supplied from the high pressure pump 48 to the common rail 38 by two fuel supply systems.

As shown by a one-dotted chain line in the drawing, pressure sensors 433 and 434 are provided in fuel supply pipes 39, so that the fuel pressure detected by the pressure sensors 433, 434 can be taken into the ECU 49. When the fuel supply pressure detected by the pressure sensors 433, 434 is decreased to a value not more than a predetermined value, the ECU49 judges that one of the fuel supply pipes, the pressure of which is decreased, has been damaged. Then, the ECU49 controls an electromagnetic valve for controlling the delivery quantity so that fuel supply to the damaged fuel supply pipe can be stopped and fuel supply to the other fuel supply pipe can be increased.

As described above, in this example, the ECU49 judges which fuel supply pipe is damaged, from the signals sent from the pressure sensors 433, 434, and in the case where one of the fuel supply pipes is damaged, fuel supply to the common rail 38 is continued by the other fuel supply pipe. Therefore, when the diesel engine is mounted on a vehicle, the vehicle can be moved to a safe place even when one of the fuel supply pipes is damaged.

INDUSTRIAL POSSIBILITY

As explained above, according to the present invention, leakage and pulsation of high pressure fuel caused when the high pressure fuel passage around the common rail has been damaged, can be prevented with a simple mechanism, and reliability of of the system can be improved.

What is claimed is:

1. An accumulator type of fuel injection device comprising:

a common rail which accumulates high pressure fuel;

an injector provided to each cylinder;

a fuel pipe connecting each said injector to said common rail so that each said injector injects the fuel into an engine being electrically controlled; and a single safety/check device provided in said fuel pipe, wherein said safety/check device both cuts off a fuel flow when an amount of fuel flowing in said safety/check device exceeds an allowed range, and allows only fuel supply from said common rail to said injector and restricts pressure transmission from said injector to said common rail, wherein said safety/check device comprises:

a housing with an inlet on a first end and an outlet on a second end, said inlet being connected to a hollow cylindrical bore inside said housing, said hollow cylindrical bore being connected to a smaller diameter bore inside said housing, said smaller diameter bore being connected to said outlet, a piston and ball valve located inside said hollow cylindrical bore and movably disposed in an axial direction, a spring urging said piston and ball valve toward said inlet, and a circular seat portion formed on a side of said piston towards said inlet, said circular seat portion blocking said inlet when a fuel pressure at said inlet side is less than a fuel pressure at said outlet side, thereby preventing a flow of fuel from said outlet to said inlet, said piston having a passage therethrough in an axial direction, wherein fuel flows into said inlet and up against said piston, flowing through said passage, hollow cylindrical bore and said smaller diameter bore to said outlet, wherein if said fuel flow exceeds said allowed range, said piston and ball valve are displaced toward said outlet against said smaller diameter bore to a closed state, thereby preventing a flow of fuel.

2. An accumulator type of fuel injection device comprising:

a common rail which accumulates high pressure fuel;

an injector provided to each cylinder;

a fuel pipe connecting each said injector to said common rail so that each said injector injects the fuel into an engine being electrically controlled; and a single safety/check device provided in said fuel pipe, wherein said safety/check device both cuts off a fuel flow when an amount of fuel flowing in said safety/check device exceeds an allowed range, and allows only fuel supply from said common rail to said injector and restricts pressure transmission from said injector to said common rail, wherein said safety/check device comprises:

a housing with an inlet on a first end and an outlet on a second end, said inlet being connected to a hollow cylindrical bore inside said housing, said hollow cylindrical bore being connected to a smaller diameter bore inside said housing, said smaller diameter bore being connected to said outlet, a piston and ball valve located inside said hollow cylindrical bore and movably disposed in an axial direction, a spring urging said piston and ball valve toward said inlet, and a check valve formed within said passage of said piston, said check valve allowing fuel to flow from said inlet to said outlet through said passage, but preventing fuel to flow from said outlet to said inlet through said passage, said piston having a passage therethrough in an axial direction, wherein fuel flows into said inlet and up against said piston, flowing through said passage, hollow cylindrical bore and said smaller diameter bore to said outlet, wherein if said fuel flow exceeds said allowed range, said piston and ball valve are displaced toward said outlet against said smaller diameter bore to a closed state, thereby preventing a flow of fuel.

* * * * *

UNITED STATES PATENT AND TRADEMARK OFFICE

CERTIFICATE OF CORRECTION

| | | |
|---|---|---|
| PATENT NO. | : | 5,511,528 |
| DATED | : | Apr. 30, 1996 |
| INVENTOR(S) | : | IWANAGA et al. |

It is certified that error appears in the above-identified patent and that said Letters Patent is hereby corrected as shown below:

ON THE COVER PAGE:

Reads: [30] Foreign Application Priority Data

| | | |
|---|---|---|
| Jan. 14, 1991 | [JP] | Japan.....3-2757 |
| Jan. 24, 1991 | [JP] | Japan.....3-6908 |
| Mar. 15, 1991 | [JP] | Japan.....3-51450 |
| Jun. 26, 1991 | [JP] | Japan.....3-154901 |

Should Read: [30] Foreign Application Priority Data

| | | |
|---|---|---|
| Jan. 14, 1991 | [JP] | Japan.....3-2757 |
| Jan. 24, 1991 | [JP] | Japan.....3-6908 |
| Mar. 15, 1991 | [JP] | Japan.....3-51450 |
| Jun. 26, 1991 | [JP] | Japan.....3-154901 |
| Jan. 13, 1992 | [JP] | PCT.....PCT/JP92/00017 |

Signed and Sealed this

Twenty-fourth Day of September, 1996

*Attest:*

Bruce Lehman

BRUCE LEHMAN

*Attesting Officer*

*Commissioner of Patents and Trademarks*